US010770025B2

(12) United States Patent
Kim et al.

(10) Patent No.: US 10,770,025 B2
(45) Date of Patent: Sep. 8, 2020

(54) METHOD FOR TRANSMITTING AND RECEIVING DATA IN DISPLAY DEVICE AND DISPLAY PANEL DRIVE DEVICE

(71) Applicant: SILICON WORKS CO., LTD., Daejeon (KR)

(72) Inventors: Myung Yu Kim, Daejeon (KR); Kwan Hee Lee, Daejeon (KR); Young Woong Kim, Daejeon (KR); Hyun Kyu Jeon, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 96 days.

(21) Appl. No.: 16/205,826

(22) Filed: Nov. 30, 2018

(65) Prior Publication Data

US 2019/0172412 A1 Jun. 6, 2019

(30) Foreign Application Priority Data

Dec. 4, 2017 (KR) ..... 10-2017-0164978

(51) Int. Cl.
*G09G 5/00* (2006.01)

(52) U.S. Cl.
CPC ..... *G09G 5/006* (2013.01); *G09G 2310/027* (2013.01); *G09G 2310/0267* (2013.01); *G09G 2310/08* (2013.01); *G09G 2320/0252* (2013.01); *G09G 2330/028* (2013.01); *G09G 2330/12* (2013.01); *G09G 2340/02* (2013.01); *G09G 2370/00* (2013.01)

(58) Field of Classification Search
CPC ..... G09G 5/006; G09G 2310/0267; G09G 2310/027; G09G 2310/08; G09G 2320/0252; G09G 2330/028; G09G 2330/12; G09G 2340/02; G09G 2370/00
See application file for complete search history.

(56) References Cited

U.S. PATENT DOCUMENTS

| | | | | |
|---|---|---|---|---|
| 8,831,161 | B2 | 9/2014 | Whitby-Strevens et al. | |
| 9,361,825 | B2 * | 6/2016 | Jeong | G09G 3/2096 |
| 10,490,158 | B2 * | 11/2019 | Kim | H04L 7/033 |
| 2014/0146058 | A1 * | 5/2014 | Jeong | G09G 3/2096 345/520 |
| 2015/0049076 | A1 * | 2/2015 | Kim | G09G 3/3685 345/212 |
| 2016/0125840 | A1 * | 5/2016 | Oh | G09G 5/008 345/213 |
| 2017/0017604 | A1 * | 1/2017 | Chen | G06F 11/3051 |
| 2017/0083133 | A1 * | 3/2017 | Kang | G02F 1/13454 |
| 2017/0193892 | A1 * | 7/2017 | Ha | G09G 3/2022 |
| 2017/0272231 | A1 * | 9/2017 | Chen | H04L 7/0016 |
| 2018/0114483 | A1 * | 4/2018 | Kim | H01L 27/3218 |
| 2018/0122294 | A1 * | 5/2018 | Do | G09G 3/3275 |
| 2019/0197987 | A1 * | 6/2019 | Kim | H04L 7/033 |

FOREIGN PATENT DOCUMENTS

KR 10-2016-0031199 A 3/2016

* cited by examiner

*Primary Examiner* — Michael Pervan
(74) *Attorney, Agent, or Firm* — Fenwick & West LLP

(57) ABSTRACT

An embodiment provides a display panel drive device that receives image data in a plurality of image reception periods within one frame period and retrains a data link according to link data received in an interval between the image reception periods.

16 Claims, 8 Drawing Sheets

METHOD FOR TRANSMITTING AND RECEIVING DATA IN DISPLAY DEVICE AND DISPLAY PANEL DRIVE DEVICE

CROSS REFERENCE TO RELATED APPLICATIONS

This application claims priority from Republic of Korea Patent Application No. 10-2017-0164978, filed on Dec. 4, 2017, which is hereby incorporated by reference in its entirety.

BACKGROUND

1. Field of Technology

The present embodiment relates to a method for transmitting and receiving data in a display device and a display panel drive device.

2. Description of the Prior Art

A display panel includes a plurality of pixels arranged in a matrix, and each pixel includes red (R), green (G), and blue (B) sub-pixels. Each pixel or each sub-pixel emits light with a grayscale value according to an image, thereby displaying the image on the entire display panel.

Image data indicating the grayscale value of each pixel or each sub-pixel is transmitted from a data processing device, called a timing controller, to a data drive device, called a source driver. The image data is transmitted as a digital value. The data drive device converts the image data having a digital value into a data voltage having an analog value and then drives each pixel or each sub-pixel.

Since image data indicates the grayscale value of each pixel individually or independently, the amount of image data increases as the number of pixels arranged on a display panel increases. As the frame rate increases, the amount of image data to be transmitted per unit time increases.

As a display panel has higher resolution in recent years, both the number of pixels arranged on a display panel and the frame rate have increased. Also, to process an increased amount of image data according to high resolution, data communication in a display device is required to be faster.

In order to transmit and receive data at a high speed, it is necessary to reduce a communication voltage and to increase the frequency of a communication clock. However, such low-voltage and high-frequency communication is vulnerable to noise.

SUMMARY

With this background, an aspect of the present embodiment is to provide a high-speed data transmission and reception technology in a display device. Another aspect of the present embodiment is to provide technology for stably performing data transmission and reception even in a noisy environment in a display device.

In view of the foregoing aspects, an embodiment provides a data drive device in a display device, the data drive device including: a data reception circuit configured to train a communication clock according to a received clock pattern, to receive first link data in accordance with the communication clock, to train a data link according to the first link data, to receive image data in a plurality of image reception periods within one frame period, to sort the image data in accordance with the data link, to receive second link data in a link reception period disposed between the image reception periods, and to retrain the data link according to the second link data; and a data voltage drive circuit configured to generate a data voltage by converting the image data and to supply the data voltage to each sub-pixel.

In the data drive device, the one frame period may include a plurality of horizontal (H) time periods respectively corresponding to a plurality of lines on a display panel, and the H time periods may include a setting reception period for receiving setting data, the image reception period, and the link reception period.

In the data drive device, when the data link that is determined as an error is restored in the link reception period of a Jth H time period (J is a natural number) among the plurality of H time periods, a process corresponding to the setting reception period or the image reception period of a (J+1)th H time period may be normally performed subsequently.

In the data drive device, the data reception circuit may check the image data or the second link data, and may generate a fail signal when the image data or the second link data is against a predefined rule.

In the data drive device, the data reception circuit may count the fail signal, and may change a state of a lock signal connected to an outside when the fail signal occurs N times or more (N is a natural number).

In the data drive device, the data reception circuit may retrain the communication clock and the data link when changing the state of the lock signal.

In the data drive device, the data reception circuit may train the communication clock by a phase-locked loop (PLL) method.

In the data drive device, the data reception circuit may sort the image data per byte, may decode the image data sorted per byte into a DC balance code, may descramble the decoded image data, and may sort the descrambled image data per pixel.

In the data drive device, the first link data and the second link data may include a plurality of symbols, and the data reception circuit may sort the image data per byte using one symbol among the plurality of symbols and may sort the image data per pixel using at least two or more symbols among the plurality of symbols.

In the data drive device, the data voltage drive circuit may supply the data voltage in the link reception period.

In the data drive device, the data voltage drive circuit may supply the data voltage according to a periodic signal indicating one point in the link reception period.

In the data drive device, the data voltage may have a greater voltage range than that of the image data or the link data.

In the data drive device, the data reception circuit may check the image data or the second link data, may generate a fail signal when the image data or the second link data is against a predefined rule, may change a state of a lock signal connected to an outside when the fail signal occurs N times or more (N is a natural number), and may re-receive the clock pattern after changing the state of the lock signal.

Another embodiment provides a data processing device including: a data processor configured to encode image data; and a data transmitter configured to transmit a clock pattern, to transmit first link data, to transmit the image data in a plurality of image transmission periods within one frame period, to transmit second link data in a link transmission period disposed between the image transmission periods, and to retransmit the clock pattern and the first link data when a state of a received lock signal is changed.

Still another embodiment provides a display drive system including: a data processing device configured to transmit a clock pattern, to transmit first link data, to transmit image data in a plurality of image transmission periods within one frame period, and to transmit second link data in a link transmission period disposed between the image transmission periods; and a data drive device configured to train a communication clock according to the received clock pattern, to receive the first link data in accordance with the communication clock, to train a data link according to the first link data, to receive the image data in a plurality of image reception periods, to sort the image data in accordance with the data link, to receive the second link data in a link reception period disposed between the image reception periods, and to retrain the data link according to the second link data.

As described above, according to the present embodiments, it is possible to transmit and receive data at a high speed in a display device, and it is possible to stably transmit and receive data even in a noisy environment in a display device.

BRIEF DESCRIPTION OF THE DRAWINGS

The above and other aspects, features and advantages of the present disclosure will be more apparent from the following detailed description taken in conjunction with the accompanying drawings, in which.

DETAILED DESCRIPTION

Figure 1:
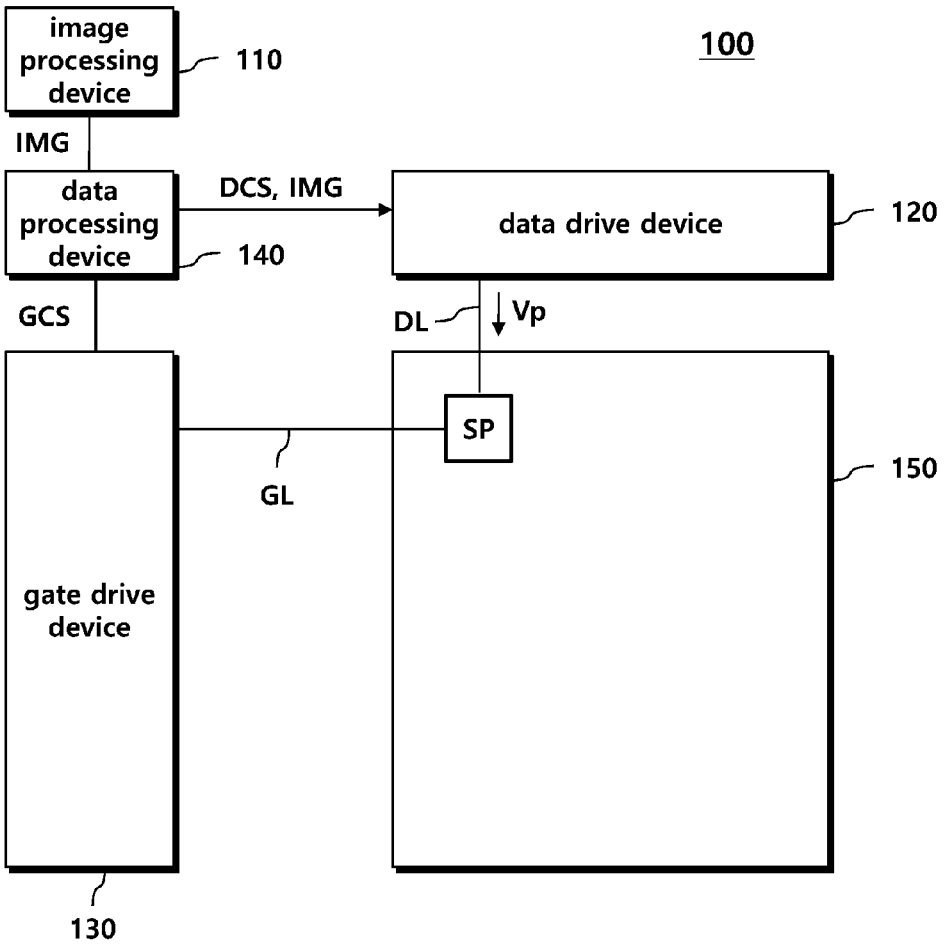
FIG. 1 illustrates the configuration of a display device according to an embodiment.

Hereinafter, some embodiments of the present disclosure will be described in detail with reference to the accompanying drawings. In the following description, the same components will be designated by the same reference numerals although they are shown in different drawings. Further, in the following description of the present invention, a detailed description of known functions and configurations incorporated herein will be omitted when it may make the subject matter of the present invention rather unclear.

In addition, terms, such as first, second, A, B, (a), (b) or the like may be used herein when describing components of the present disclosure. These terms are merely used to distinguish one structural element from other structural elements, and a property, an order, a sequence and the like of a corresponding structural element are not limited by the term. It should be noted that if it is described in the specification that one component is "connected," "coupled" or "joined" to another component, a third component may be "connected," "coupled," and "joined" between the first and second components, although the first component may be directly connected, coupled or joined to the second component.

FIG. 1 illustrates the configuration of a display device according to an embodiment.

Referring to FIG. 1, the display device 100 may include a plurality of display panel drive devices: an image processing device 110, a data drive device 120, a gate drive device 130, a data processing device 140, and a display panel 150.

A plurality of data lines DL and a plurality of gate lines GL may be disposed on a display panel 150, and a plurality of pixels may be disposed on the display panel 150. A pixel P may include a plurality of sub-pixels SP. The sub-pixels may be red (R), green (G), blue (B), and white (W) sub-pixels. One pixel may include RGB sub-pixels SP, RGBG sub-pixels SP, or RGBW sub-pixels SP. Hereinafter, for the convenience of explanation, one pixel is described as including RGB sub-pixels.

The display panel drive devices 110, 120, 130, and 140 are devices that generate signals to display an image on the display panel 150, and include an image processing device 110, a data drive device 120, a gate drive device 130, and a data processing device 140.

The gate drive device 130 may supply a gate drive signal of a turn-on voltage or a turn-off voltage to a gate line GL. When a gate drive signal of a turn-on voltage is supplied to a sub-pixel SP, the sub-pixel SP is connected to a data line DL. When a gate drive signal of a turn-off voltage is supplied to the sub-pixel SP, the sub-pixel SP is disconnected from the data line DL. The gate drive device 130 may be referred to as a gate driver.

The data drive device 120 may supply a data voltage Vp to a sub-pixel SP through a data line DL. The data voltage Vp supplied to the data line DL may be supplied to the sub-pixel SP according to a gate drive signal. The data drive device 120 may be referred to as a source driver.

The data processing device 140 may supply a control signal to the gate drive device 130 and the data drive device 120. For example, the data processing device 140 may transmit a gate control signal GCS, which initiates scanning, to the gate drive unit 130. Then, the data processing device 140 may output image data IMG to the data drive device 120. Further, the data processing device 140 may transmit a data control signal DCS that controls the data drive device 120 to supply a data voltage Vp to each sub-pixel SP. The data processing device 140 may be referred to as a timing controller.

The image processing device 110 may generate image data IMG and may transmit the image data IMG to the data processing device 140. The image processing device 110 may be referred to as a host.

A high-speed communication interface may be formed between the data processing device 140 and the data drive device 120, and the data processing device 140 may transmit a data control signal DCS and/or image data IMG to the data driver device 120 through the high-speed communication interface.

Figure 2:
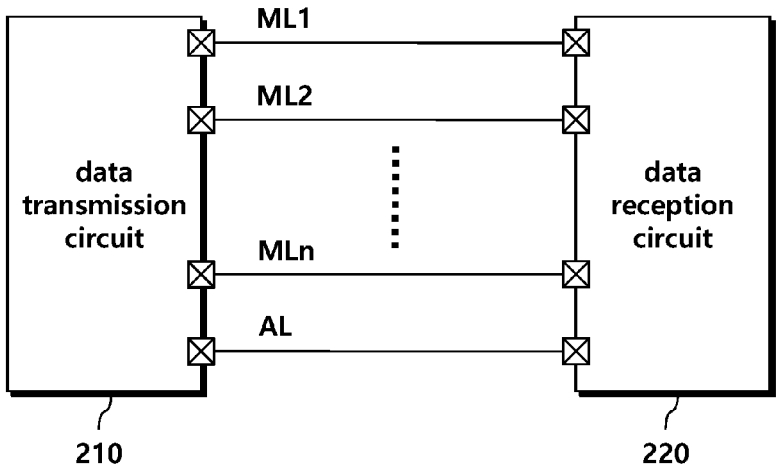
FIG. 2 illustrates a connection relationship between a data transmission circuit and a data reception circuit according to an embodiment.

FIG. 2 illustrates a connection relationship between a data transmission circuit and a data reception circuit according to an embodiment.

The data transmission circuit 210 may be included in the foregoing data processing device (see 140 in FIG. 1), and the data reception circuit 220 may be included in the foregoing data drive device (see 120 in FIG. 1).

The data transmission circuit 210 and the data reception circuit 220 may be connected via a plurality of main lines ML1, ML2, . . . , and MLn and at least one auxiliary line AL.

Data may be transmitted through the main lines ML1, ML2, . . . , and MLn. The data may include information and may include a pattern.

Data including information, for example, setting data, image data, and link data, may be transmitted through the main lines ML1, ML2, . . . , and MLn. The setting data may include the data control signal (see DCS in FIG. 1) described with reference to FIG. 1, and the image data may be the image data (see IMG in FIG. 1) described with reference to FIG. 1. The link data may include information necessary for training a data link, which will be described later.

The data may include a pattern. For example, particular data may have a form of repeating bits 1 and 0, and this data may be used to identify a pattern, such as for clock training, instead of being used to acquire information. The pattern included in the data used for clock training is also referred to as a clock pattern.

The link data may also include a particular pattern, and this particular pattern may include a pattern indicating a byte unit or a pixel unit. The pattern included in the link data is also referred to as a link pattern.

Low-voltage and high-frequency communication signals may be transmitted through the main lines ML1, ML2, . . . , and MLn.

The main lines ML1, ML2, . . . , and MLn may be paired by two lines, and two paired lines may transmit a communication signal by a differential method. Here, a voltage formed in the two lines may be a low voltage. Here, the low voltage is a voltage smaller than the voltage range of a data voltage supplied to each sub-pixel and may be, for example, 3.3 V. The voltage range of the data voltage may be understood, for example, as the difference between a data voltage at the minimum grayscale value or a data voltage at the maximum grayscale value and a voltage formed in the data line when a data voltage is not supplied.

An auxiliary signal may be transmitted via the auxiliary line AL. The auxiliary signal may be, for example, a signal indicating the state of the data reception circuit 220. When the auxiliary signal has a voltage of a first level, the data reception circuit 220 may be in a state of being able to receive data. When the auxiliary signal has a voltage of a second level, the data reception circuit 220 may be in a state of not being able to receive data. Here, the first level and the second level may be different voltage levels. The auxiliary signal may be referred to as a lock signal. In a phase-locked loop (PLL) method, a data reception side may have a process for adjusting the phase of a clock to a communication signal. When the phase of the clock is adjusted, a lock signal may be changed to a high level.

In one embodiment, a lock signal may be transmitted via the auxiliary line AL. Here, the lock signal may not only indicate whether the phase of the clock is adjusted but also indicate other states of the data reception circuit 220. For example, the change of the lock signal from the high level to a low level may indicate that the data reception circuit 220 is in a state of not being able to receive data or that a communication signal transmitted to the data reception circuit 220 is abnormal.

Figure 3:
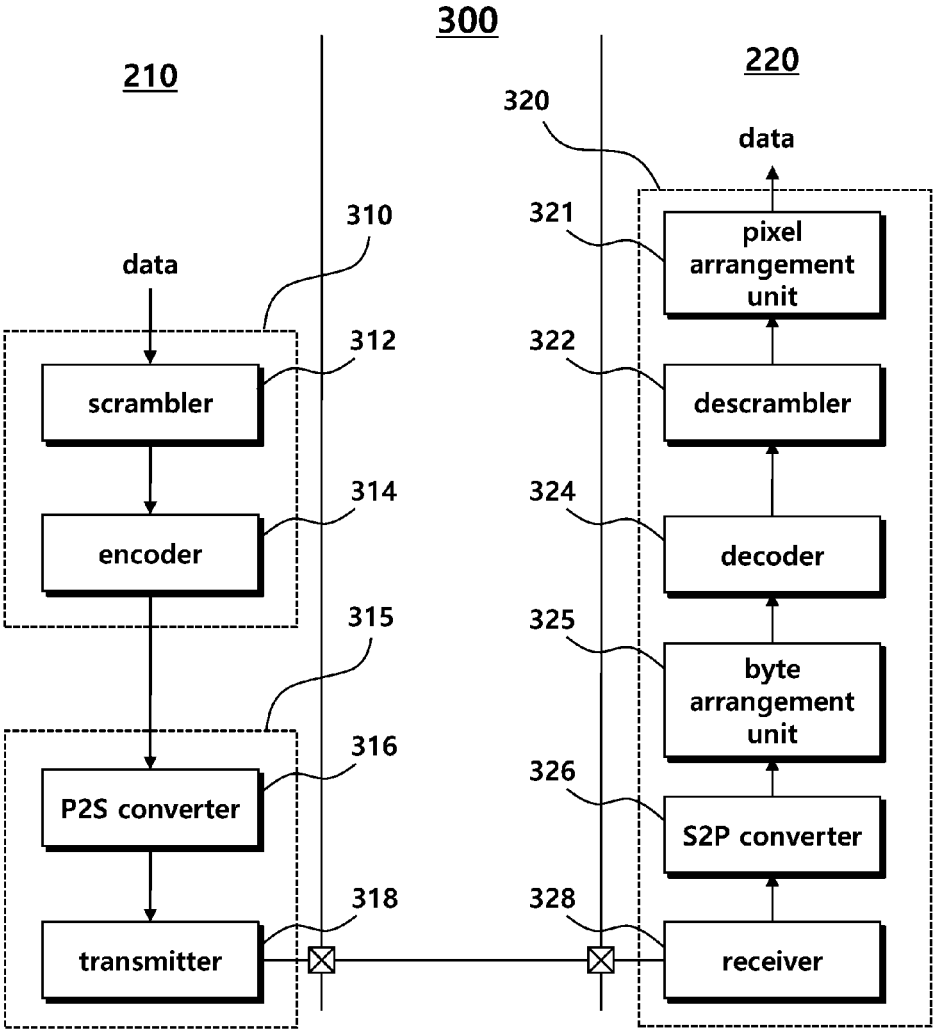
FIG. 3 illustrates the configuration of a drive system including a data transmission circuit and a data reception circuit according to an embodiment.

FIG. 3 illustrates the configuration of a drive system including a data transmission circuit and a data reception circuit according to an embodiment.

Referring to FIG. 3, the drive system 300 for a display may include the data transmission circuit 210 and the data reception circuit 220.

The data transmission circuit 210 may include a scrambler 312, an encoder 314, a P2S converter 316, and a transmitter 318. The data reception circuit 220 may include a receiver 328, an S2P converter 326, a byte arrangement unit 325, a decoder 324, a descrambler 322, and a pixel arrangement unit 321. In the data transmission circuit 210, the scrambler 312 and the encoder 314 may be grouped into a data processor 310, and the P2S converter 316 and the transmitter 318 may be grouped into a data transmitter 315. In the data reception circuit 220, the receiver 328, the S2P converter 326, the byte arrangement unit 325, the decoder 324, the descrambler 322, and the pixel arrangement unit 321 may be grouped into a data receiver 320.

In the data transmission circuit 210, data is scrambled by the scrambler 312. Scrambling is a process of shuffling bits of transmitted data, which can prevent equal bits, for example, 1s or 0s, from being disposed K (K is a natural number of 2 or greater) times or more consecutively in a transport stream of the data. Scrambling may be performed according to prearranged rules, and the descrambler 322 of the data reception circuit 220 may perform a function of reconstructing the stream of the shuffled bits back to the original data.

The encoder 314 may encode P bits of the transport stream of the data into Q bits. P may be, for example, 8, and Q may be, for example, 10. Encoding 8-bit data into 10-bit data is referred to as 8B10B encoding. 8B10B encoding is a method of encoding into a DC balance code.

The encoder 314 may encode the data so that the number of bits of the transport stream is increased. The encoded data may be decoded by the decoder 324 of the data reception circuit 220 into a DC balance code, for example, 8B10B. In another aspect, the encoded data may be reconstructed by the decoder 324 of the data reception circuit 220 to the original bits.

The data transmitted in parallel in the data transmission circuit 210 may be serially converted for transmission between the data transmission circuit 210 and the data reception circuit 220. The serial-and-parallel conversion of the data may be performed by the P2S converter 316 of the data transmission circuit 210. The S2P converter 326 of the data reception circuit 210 may perform a function of parallelly converting data serially received.

The data serially converted through scrambling and encoding may be transmitted to the data reception circuit 220 through the transmitter 318 of the data transmission circuit 210.

The data received by the data reception circuit 220 may be transmitted to the byte arrangement unit 325, the decoder 324, the descrambler 322, and the pixel arrangement unit 321 via the receiver 328 and the S2P converter 326.

The byte arrangement unit 325 may sort the data by the byte. A byte is a basic unit of forming information included in the data and may be, for example, 8 bits, 10 bits, or the like. The byte arrangement unit 325 may sort the data so that the data serially transmitted may be separated and read out by the byte.

The pixel arrangement unit 321 may sort the data by the pixel. The data may sequentially include information corresponding to RGB sub-pixels. The pixel arrangement unit 321 may sort the data so that the data serially transmitted may be separated and read out by the pixel.

The data reception circuit 220 may sort the data according to a data link.

Figure 4:
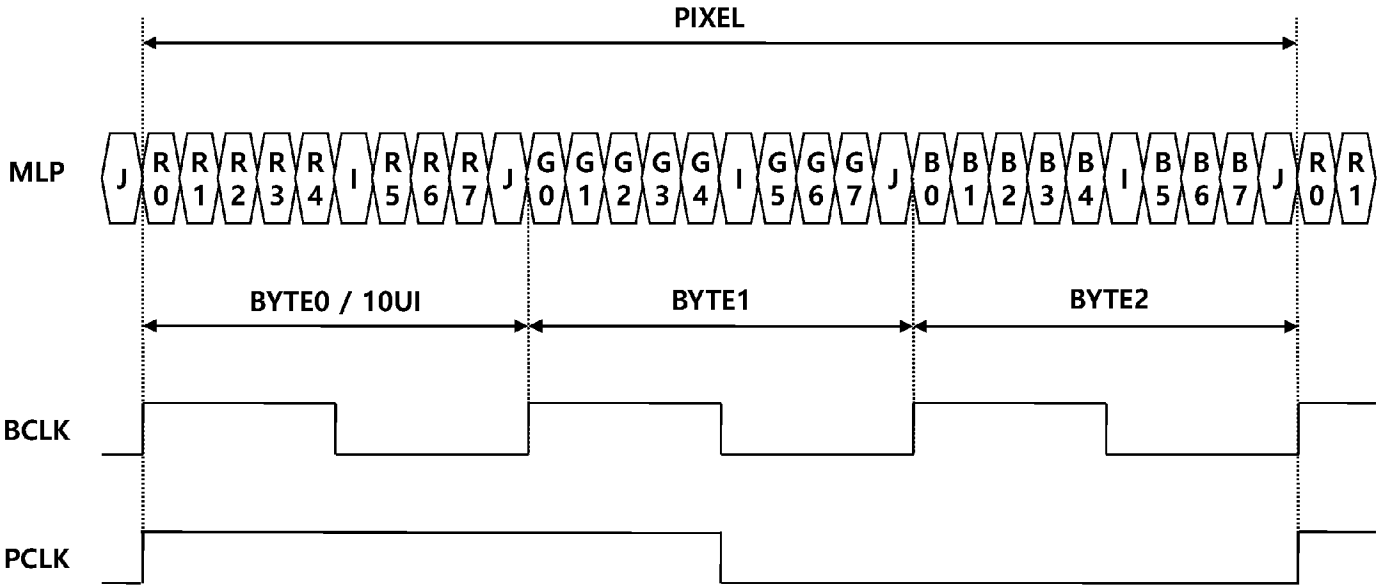
FIG. 4 illustrates an example of data and a data link according to an embodiment.

FIG. 4 illustrates an example of data and a data link according to an embodiment.

Referring to FIG. 4, one byte BYTE may include ten bits (UI).

A data reception circuit may sort data in accordance with a byte clock BCLK. Here, the byte clock BCLK may be considered as one component of a data link. The data reception circuit may sort the data such that the start of each byte BYTE0, BYTE1, and BYTE2 of the data may be positioned in accordance with the rising edge of the byte clock BCLK.

Image data among the data is transmitted in the predetermined order of sub-pixels. For example, in the example of the data shown in FIG. 4, image data is transmitted in the order of R, G, and B.

The data reception circuit may sort the data in accordance with a pixel clock PCLK. Here, the pixel clock PCLK may be considered as another component of the data link. The data reception circuit may sort the data such that the start of each pixel PIXEL of the data, for example, data corresponding to R, is positioned in accordance with the rising edge of the pixel clock PCLK.

Figure 5:
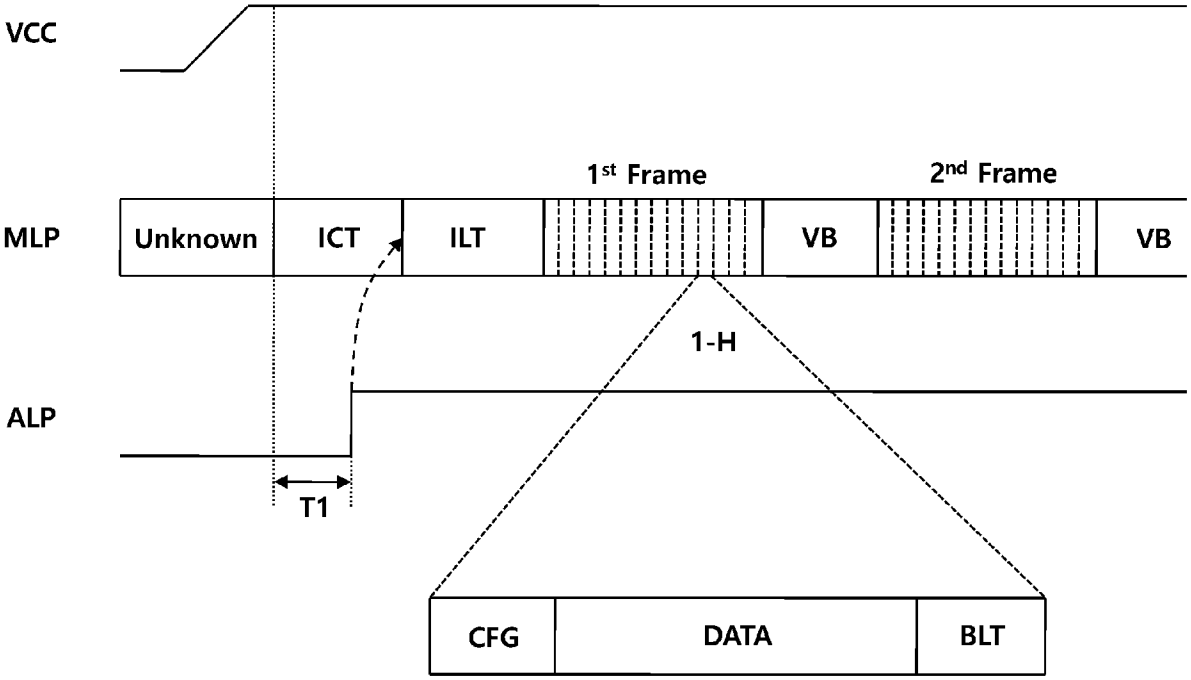
FIG. 5 illustrates a sequence of a communication signal and an auxiliary signal according to an embodiment.

FIG. 5 illustrates a sequence of a communication signal and an auxiliary signal according to an embodiment. FIG. 5 complementally illustrates the waveform of a driving voltage VCC supplied to a data transmission circuit.

Here, the communication signal MLP is a signal transmitted through a main line described with reference to FIG. 2, and the auxiliary signal ALP is a signal transmitted through an auxiliary line described with reference to FIG. 2.

When the driving voltage VCC is supplied to the data transmission circuit, the data transmission circuit may transmit a clock pattern through the main line within a certain time.

A data reception circuit may receive the clock pattern and may train a communication clock according to the clock pattern. After completing training the communication clock, the data reception circuit may change the state of the auxiliary signal ALP formed in the auxiliary line from a low level to a high level.

The data transmission circuit and the data reception circuit may perform communication by a phase-locked loop (PLL) method. In this method, the data reception circuit may train the communication clock by the PLL method that generates an internal communication clock in accordance with the frequency and phase of a clock pattern.

The data reception circuit may complete the clock training within a first time T1. The data transmission circuit may transmit the clock pattern during an initial clock training period ICT, which is longer than the first time T1, including a certain margin time.

The clock training may be performed only once at an initial stage for transmitting data. When a link between the data transmission circuit and the data reception circuit is broken, the clock training may be performed again at the initial stage.

After the clock training is completed, the data transmission circuit may transmit link data through the main line.

The data reception circuit may receive the link data in accordance with the communication clock and may train a data link according to the link data. The link training may be performed during an initial link training period ILT in which the data transmission circuit transmits the link data.

The link training may be performed only once at an initial stage for transmitting data. When the link between the data transmission circuit and the data reception circuit is broken, the link training may be performed again at the initial stage.

After the link training is completed, the data transmission circuit may transmit image data through the main line.

The image data may be transmitted by the frame. A vertical blank period VB may exist between periods for image data transmission by the frame.

One frame period may include a plurality of sub-time periods, and image data may be transmitted in one period of the sub-time periods.

For example, one frame period may include a plurality of horizontal (H) time periods 1-H (horizontal period) respectively corresponding to a plurality of lines of a display panel. The data transmission circuit may transmit image data corresponding to each line in each H time period 1-H.

For the data transmission circuit, a H time period 1-H may include, for example, a setting transmission period (period for transmitting setting data), an image transmission period, and a link transmission period. The data transmission circuit may transmit image data in the image transmission period of each H time period 1-H. For the data reception circuit, a H time period 1-H may include a setting reception period CFG, an image reception period DATA, and a link reception period BLT. The data reception circuit may receive image data in the image reception period DATA.

The data reception circuit may receive image data in the image reception period DATA and may sort the image data in accordance with the data link. Since the image data is transmitted without a separate clock or link signal, the data reception circuit needs to properly separate and read out the image data. The data reception circuit may sort the image data in accordance with the foregoing data link and may properly separate and read out the image data.

The link reception period BLT may be arranged between the image reception periods DATA for receiving image data, and the data reception circuit may receive link data in the link reception period BLT. The data reception circuit may retrain the data link according to the link data received in the link reception period BLT.

The link data transmitted and received in the initial link training period ILT and the link data transmitted and received in the link reception period BLT may be the same or may be different from each other. Hereinafter, for the convenience of description, an embodiment will be described in which the link data transmitted and received in the initial link training period ILT and the link data transmitted and received in the link reception period BLT may be the same.

The data reception circuit may check setting data, image data, or link data, and may generate a fail signal when the setting data, the image data, or the link data is against a predefined rule. The fail signal indicates that the link between the data transmission circuit and the data reception circuit is broken. The data reception circuit counts the fail signal. When the fail signal occurs N times (N is a natural number) or more, the data reception circuit may change the state of the auxiliary signal connected to the data transmission circuit.

When the state of the auxiliary signal is changed, the data transmission circuit may retransmit the clock pattern during the initial clock training period ICT and may retransmit the link data during the initial link training period ILT at the initial stage. The data reception circuit may retrain the communication clock in accordance with the clock pattern and may retrain the data link according to the link data.

When the clock is broken, the link is also broken. In this case, the data reception circuit may determine that an abnormality has occurred in the setting data, the image data, or the link data. Here, an initialization stage of performing both the clock training and the link training is performed. However, when only the link is broken due to temporary noise, re-performing only the link training may continue data transmission and reception without going through the initialization stage.

The data reception circuit according to the embodiment may receive the link data in the link reception period BLT included in each H time period 1-H and may continuously retrain the data link, thereby quickly restoring the data link even when the link is temporarily damaged.

For example, in a situation where it is determined that there is an error in the data link before a Jth H time period (J is a natural number), when the data link determined as an error is restored in the link reception period BLT of the Jth H time period, the setting reception period CFG or the image reception period DATA of a (J+1)th H time period may subsequently proceed. In another aspect, when the data link is restored in the link reception period BLT, the data reception circuit may receive subsequent image data without going through the initial stage.

The link data may include a plurality of symbols. The data reception circuit may sort the image data by the byte using one symbol among the plurality of symbols included in the link data and may sort the image data by the pixel using at least two or more symbols among the plurality of symbols included in the link data.

Figure 6:
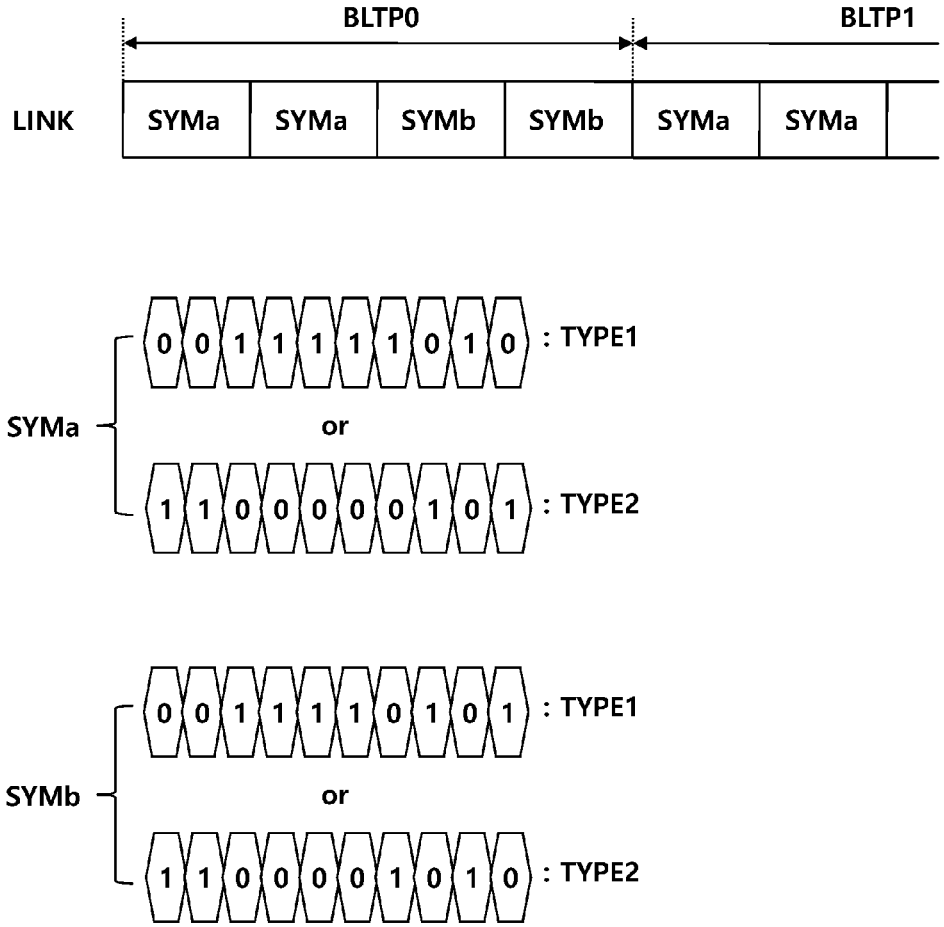
FIG. 6 illustrates link data according to an embodiment.

FIG. 6 illustrates link data according to an embodiment.

Referring to FIG. 6, the link data LINK may have a form in which two or more link patterns BLTP0 and BLTP1 consecutively including two first symbols SYMa and two second symbols SYMb are consecutively arranged.

The first symbols SYMa may represent 0011111010 or 1100000101, and the second symbols SYMb may represent 0011110101 or 1100001010. These special link patterns BLTP0 and BLTP1 have the effect of improving the accuracy of link training.

The foregoing data transmission circuit may be applied to the data processing device 140 described with reference to FIG. 1, and the foregoing data reception circuit may be applied to the data drive device 120 described with reference to FIG. 1. An example of the data drive device 120 to which the data reception circuit is applied will be described according to an embodiment.

Figure 7:
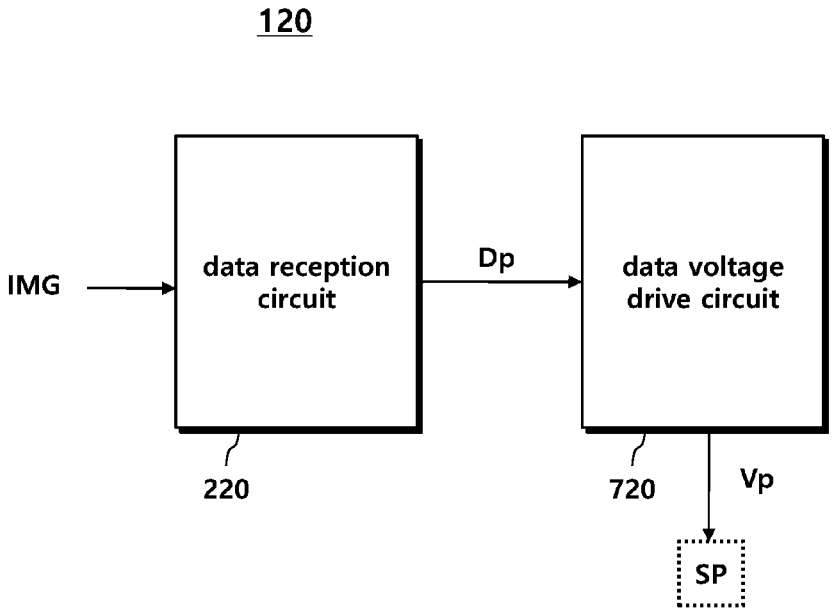
FIG. 7 illustrates the configuration diagram of a data drive device according to an embodiment.

FIG. 7 illustrates the configuration diagram of a data drive device according to an embodiment.

Referring to FIG. 7, the data drive device 120 may include a data reception circuit 220 and a data voltage drive circuit 720.

The data reception circuit 220 may receive image data IMG from a data processing circuit. The data reception circuit 220 may transmit grayscale data Dp corresponding to each sub-pixel of the image data IMG to the data voltage drive circuit 720 as a digital value.

The data voltage drive circuit 720 may convert the grayscale data Dp transmitted as the digital value to generate a data voltage Vp and may supply the data voltage Vp to each sub-pixel SP.

The voltage range of the data voltage Vp may be greater than the voltage range of the image data IMG. Accordingly, the data reception circuit 220 mainly includes a low-voltage element, and the data voltage drive circuit 720 mainly includes a high-voltage element.

The high-voltage data voltage Vp generated in the data voltage drive circuit 720 may be recognized as a noise source for the data reception circuit 220. Since the data voltage Vp is repeatedly supplied once for each line of a display panel, the data voltage Vp may be recognized as periodic noise by the data reception circuit 220.

To prevent communication with the data processing circuit from being interrupted by periodic noise due to the data voltage Vp, the data reception circuit 220 may receive link data during an interval between periods for receiving image data and may retrain data link according to the link data.

Figure 8:
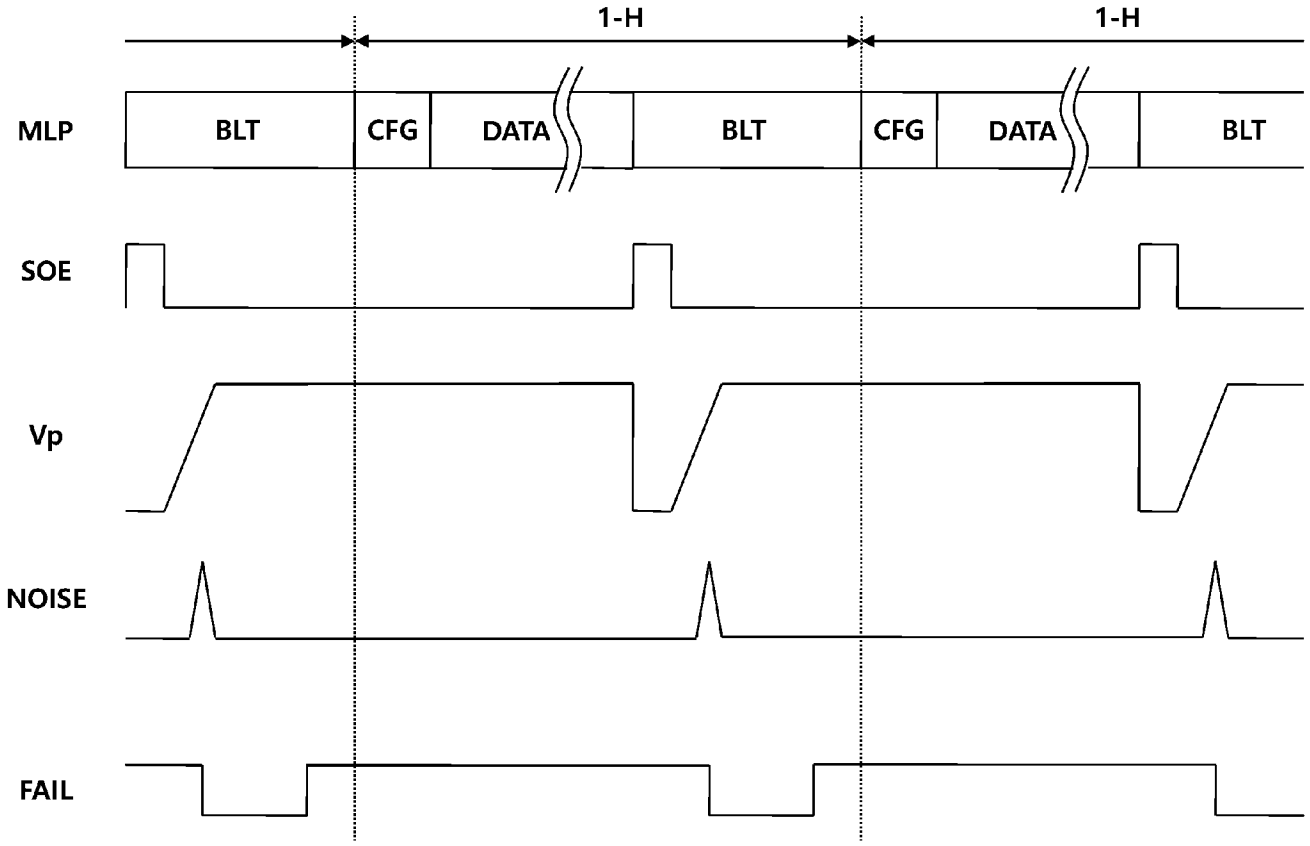
FIG. 8 illustrates a main signal waveform in a data drive device according to the embodiment.

FIG. 8 illustrates a main signal waveform in a data drive device according to the embodiment.

Referring to FIG. 8, a setting reception period CFG, an image reception period DATA, and a link reception period BLT are repeatedly arranged in each H time period 1-H, and a data reception circuit may receive setting data, image data, and link data in the respective periods.

A data voltage drive circuit may supply a data voltage Vp in the link reception period BLT. When supplying the data voltage Vp, if a load receiving the data voltage Vp, for example, a gate terminal of a driving transistor disposed in each sub-pixel, is a capacitive load, a great amount of current may temporarily flow in a data line, thus causing noise. Such noise may affect a data reception circuit.

The data reception circuit may check setting data, image data, or link data, and may generate a fail signal FAIL when the setting data, the image data, or the link data is against a predefined rule. When noise occurs due to the data voltage Vp, the data reception circuit may generate a fail signal FAIL.

The data reception circuit can retrain a link using the link data received in the link reception period BLT. Thus, even though the fail signal FAIL occurs, the data reception circuit may not immediately change the state of an auxiliary signal, for example, a lock signal. When the fail signal FAIL occurs N times (N is a natural number) or more, the data reception circuit may change the state of the auxiliary signal. Further, when the state of the auxiliary signal is changed, the data reception circuit may re-perform clock training by re-receiving a clock pattern and may re-perform link training by re-receiving link data.

Since the setting data and the image data include important information necessary for the operation of the data voltage drive circuit, the data voltage drive circuit may supply the data voltage Vp, which is highly likely to cause noise, in the link reception period BLT.

The data voltage drive circuit may supply the data voltage Vp according to a periodic signal SOE indicating one point in the link reception period BLT. The periodic signal SOE may include a pulse having a certain width, and the data voltage drive circuit may supply the data voltage Vp in accordance with the falling edge of the pulse.

As described above, a few embodiments have been described. According to these embodiments, it is possible to transmit and receive data at a high speed in a display device, and it is possible to stably transmit and receive data even in a noisy environment in a display device.

In addition, since terms, such as "including," "comprising," and "having" mean that one or more corresponding components may exist unless they are specifically described to the contrary, it shall be construed that one or more other components can be included. All the terms that are technical, scientific or otherwise agree with the meanings as understood by a person skilled in the art unless defined to the contrary. Common terms as found in dictionaries should be interpreted in the context of the related technical writings not too ideally or impractically unless the present invention expressly defines them so.

Although an embodiment of the present disclosure has been described for illustrative purposes, those skilled in the art will appreciate that various modifications, additions and substitutions are possible, without departing from the scope and spirit of the invention as disclosed in the accompanying claims. Therefore, the embodiments disclosed in the present disclosure are intended to illustrate the scope of the technical idea of the present disclosure, and the scope of the present disclosure is not limited by the embodiment. The scope of the present disclosure shall be construed on the basis of the accompanying claims in such a manner that all of the technical ideas included within the scope equivalent to the claims belong to the present disclosure.

What is claimed is:

1. A data drive device in a display device, the data drive device comprising:

a data reception circuit configured to train a communication clock according to a received clock pattern, to receive first link data in accordance with the communication clock, to train a data link according to the first link data, to receive image data in a plurality of image reception periods within one frame period, to sort the image data in accordance with the data link, to receive second link data in a link reception period disposed between the plurality of image reception periods, and to retrain the data link according to the second link data; and a data voltage drive circuit configured to generate a data voltage by converting the image data and to supply the data voltage to each sub-pixel.

2. The data drive device of claim 1, wherein the one frame period comprises a plurality of horizontal (H) time periods respectively corresponding to a plurality of lines on a display panel, and the plurality of H time periods comprise a setting reception period for receiving setting data, the image reception period, and the link reception period.

3. The data drive device of claim 2, wherein, when the data link that is determined as an error is restored in the link reception period of a Jth H time period (J is a natural number) among the plurality of H time periods, a process corresponding to the setting reception period or the image reception period of a (J+1)th H time period is normally performed subsequently.

4. The data drive device of claim 1, wherein the data reception circuit checks the image data or the second link data, and generates a fail signal when the image data or the second link data is against a predefined rule.

5. The data drive device of claim 4, wherein the data reception circuit counts the fail signal, and changes a state of a lock signal connected to an outside when the fail signal occurs N times or more (N is a natural number).

6. The data drive device of claim 5, wherein the data reception circuit retrains the communication clock and the data link when changing the state of the lock signal.

7. The data drive device of claim 1, wherein the data reception circuit trains the communication clock by a phase-locked loop (PLL) method.

8. The data drive device of claim 1, wherein the data reception circuit sorts the image data per byte, decodes the image data sorted per byte into a DC balance code, descrambles the decoded image data, and sorts the descrambled image data per pixel.

9. The data drive device of claim 1, wherein the first link data and the second link data comprise a plurality of symbols, and the data reception circuit sorts the image data per byte using one symbol among the plurality of symbols and sorts the image data per pixel using at least two or more symbols among the plurality of symbols.

10. The data drive device of claim 1, wherein the data voltage drive circuit supplies the data voltage in the link reception period.

11. The data drive device of claim 1, wherein the data voltage drive circuit supplies the data voltage according to a periodic signal indicating one point in the link reception period.

12. The data drive device of claim 1, wherein the data voltage has a greater voltage range than that of the image data or the link data.

13. The data drive device of claim 1, wherein the data reception circuit checks the image data or the second link data, generates a fail signal when the image data or the second link data is against a predefined rule, changes a state of a lock signal connected to an outside when the fail signal occurs N times or more (N is a natural number), and re-receives the clock pattern after changing the state of the lock signal.

14. A data processing device comprising:

a data processor configured to encode image data; and a data transmitter configured to transmit a clock pattern, to transmit first link data, to transmit the image data in a plurality of image transmission periods within one frame period, to transmit second link data in a link transmission period disposed between the plurality of image transmission periods, and to retransmit the clock pattern and the first link data when a state of a received lock signal is changed.

15. The data processing device of claim 14, wherein the one frame period comprises a plurality of horizontal (H) time periods respectively corresponding to a plurality of lines on a display panel, and the plurality of H time periods comprise a setting reception period for receiving setting data, the image reception period, and the link reception period.

16. A display drive system comprising:

a data processing device configured to transmit a clock pattern, to transmit first link data, to transmit image data in a plurality of image transmission periods within one frame period, and to transmit second link data in a link transmission period disposed between the image transmission periods; and a data drive device configured to train a communication clock according to the received clock pattern, to receive the first link data in accordance with the communication clock, to train a data link according to the first link data, to receive the image data in a plurality of image reception periods, to sort the image data in accordance with the data link, to receive the second link data in a link reception period disposed between the plurality of image reception periods, and to retrain the data link according to the second link data.

* * * * *